US011804180B2

(12) United States Patent
Wang

(10) Patent No.: US 11,804,180 B2
(45) Date of Patent: Oct. 31, 2023

(54) PIXEL DRIVING CIRCUIT, METHOD FOR DRIVING THE SAME AND DISPLAY DEVICE

(71) Applicant: BOE Technology Group Co., Ltd., Beijing (CN)

(72) Inventor: Bo Wang, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/761,544

(22) PCT Filed: Apr. 15, 2021

(86) PCT No.: PCT/CN2021/087446
§ 371 (c)(1),
(2) Date: Mar. 17, 2022

(87) PCT Pub. No.: WO2021/227764
PCT Pub. Date: Nov. 18, 2021

(65) Prior Publication Data

US 2022/0383813 A1 Dec. 1, 2022

(30) Foreign Application Priority Data

May 14, 2020 (CN) ..... 202010406866

(51) Int. Cl.
*G09G 3/3233* (2016.01)
*G09G 3/3266* (2016.01)

(52) U.S. Cl.
CPC ..... *G09G 3/3233* (2013.01); *G09G 3/3266* (2013.01); *G09G 2300/0819* (2013.01); *G09G 2300/0842* (2013.01); *G09G 2310/08* (2013.01); *G09G 2320/0233* (2013.01); *G09G 2320/0247* (2013.01)

(58) Field of Classification Search
CPC ..... G09G 3/3233; G09G 3/3266; G09G 2300/0819; G09G 2300/0842;
(Continued)

(56) References Cited

U.S. PATENT DOCUMENTS

2016/0005384 A1 1/2016 Yoon et al.
2018/0033370 A1 2/2018 Zheng
(Continued)

FOREIGN PATENT DOCUMENTS

CN 104575377 A 4/2015
CN 105590955 A 5/2016
(Continued)

OTHER PUBLICATIONS

CN 202010406866.8 first office action.
PCT/CN2021/087446 international search report and written opinion.

*Primary Examiner* — Kenneth B Lee, Jr.
(74) *Attorney, Agent, or Firm* — IPRO, PLLC

(57) ABSTRACT

The present disclosure provides a pixel driving circuit, a method for driving the same, and a display device. A first reset sub-circuit included in the pixel driving circuit is used to control to connect or disconnect a gate electrode of a driving transistor and a common node, and to connect or disconnect the common node and the first initialization voltage input terminals; control to connect or disconnect the common node and a second initialization voltage input terminal under the control of a first control terminal; a difference between a potential of a second initialization signal inputted by the second initialization signal input terminal and a potential of a gate electrode of the driving transistor during a light emission period is smaller than a threshold value.

20 Claims, 10 Drawing Sheets

(58) Field of Classification Search
CPC ..... G09G 2310/08; G09G 2320/0233; G09G 2320/0247
See application file for complete search history.

(56) References Cited

U.S. PATENT DOCUMENTS

| | | | | |
|---|---|---|---|---|
| 2018/0166021 | A1* | 6/2018 | Xi | G09G 3/3241 |
| 2018/0166025 | A1* | 6/2018 | Zhou | G09G 3/3233 |
| 2018/0261160 | A1* | 9/2018 | Wu | G09G 3/3258 |
| 2019/0088689 | A1 | 3/2019 | Umezaki | |
| 2019/0221165 | A1 | 7/2019 | Park et al. | |
| 2020/0005714 | A1 | 1/2020 | Wu | |
| 2020/0234633 | A1 | 7/2020 | Wang et al. | |
| 2021/0193780 | A1* | 6/2021 | Diao | H10K 59/123 |
| 2021/0335246 | A1* | 10/2021 | Qu | G09G 3/3241 |
| 2022/0013066 | A1 | 1/2022 | Mao | |

FOREIGN PATENT DOCUMENTS

| | | | |
|---|---|---|---|
| CN | 205541822 | U | 8/2016 |
| CN | 106935198 | A | 7/2017 |
| CN | 107342044 | A | 11/2017 |
| CN | 107665672 | A | 2/2018 |
| CN | 108777131 | A | 11/2018 |
| CN | 109036250 | A | 12/2018 |
| CN | 110047428 | A | 7/2019 |
| CN | 110675822 | A | 1/2020 |
| CN | 111276099 | A | 6/2020 |
| CN | 111445863 | A | 7/2020 |
| WO | 2018168174 | A1 | 9/2018 |

* cited by examiner

PIXEL DRIVING CIRCUIT, METHOD FOR DRIVING THE SAME AND DISPLAY DEVICE

CROSS-REFERENCE TO RELATED APPLICATION

This application is the U.S. national phase of PCT Application No. PCT/CN2021/087446 filed on Apr. 15, 2021, which claims priorities of the Chinese patent application No. 202010406866.8 filed on May 14, 2020, which is incorporated herein by reference in its entity.

TECHNICAL FIELD

The present disclosure relates to the field of display technology, and more particularly to a pixel driving circuit, a method for driving the same and a display device.

BACKGROUND

Active-matrix Organic Light-Emitting Diode (AMOLED) display devices have many advantages such as self-luminous, ultra-thin, fast response, high contrast, wide viewing angle, etc., have received widespread attention.

The AMOLED display device includes a plurality of pixel driving circuits and a plurality of light-emitting elements, and the pixel driving circuits are used to drive the corresponding light-emitting elements to emit light, thereby realizing the display function of the AMOLED display device. However, when the existing pixel driving circuit is driven at a low frequency, the gate electrode of the driving transistor in the pixel driving circuit has serious current leakage, so that the display device is prone to flicker during display.

SUMMARY

The objective of the present disclosure is to provide a pixel driving circuit, a method for driving the same and a display device.

A first aspect of the present disclosure provides A pixel driving circuit for driving a light-emitting element, includes: a driving sub-circuit, the driving sub-circuit includes a driving transistor, and a second electrode of the driving transistor is connected to the light-emitting element; a storage sub-circuit, a first terminal of the storage sub-circuit is connected to a gate electrode of the driving transistor, and a second terminal of the storage sub-circuit is connected to a power signal input terminal; a power control sub-circuit, respectively connected with a first control terminal, a power signal input terminal and a first electrode of the driving transistor; a data writing-in sub-circuit, connected to a gate line of corresponding row, a data line of corresponding column and a first electrode of the driving transistor; a compensation sub-circuit, connected to the gate line of corresponding row, the gate electrode of the driving transistor and the second electrode of the driving transistor; a first reset sub-circuit, connected to a reset control terminal, a first control terminal, the gate electrode of the driving transistor, a common node, a first initialization voltage input terminal and a second initialization voltage input terminal; configured to controls to connect or disconnect the gate electrode of the driving transistor and the common node under the control of the reset control terminal, and controls to connect or disconnect the common node and the first initialization voltage input terminal; and controls to connect or disconnect the common node and the second initialization voltage input terminal under the control of the first control terminal; a difference between a potential of a second initialization signal inputted by the second initialization voltage input terminal and a potential of the gate electrode of the driving transistor during a light-emitting period is smaller than a threshold value.

Optionally, the first reset sub-circuit includes: a first reset control sub-circuit, respectively connected to the reset control terminal, the gate electrode of the driving transistor and the common node; configured to control to connect or disconnect the gate electrode of the driving transistor and the common node under the control of the reset control terminal; a second reset control sub-circuit, respectively connected to the reset control terminal, the common node and the first initialization voltage input terminal; configured to control to connect or disconnect the common node and the first initialization voltage input terminal under the control of the reset control terminal; a third reset control sub-circuit, respectively connected to the first control terminal, the common node and the second initialization voltage input terminal; configured to control to connect or disconnect the common node and the second initialization voltage input terminal under the control of the first control terminal.

Optionally, the first reset control sub-circuit includes a first transistor, a gate electrode of the first transistor is connected to the reset control terminal, and a first electrode of the first transistor is connected to the common node, and a second electrode of the first transistor is connected to the gate electrode of the driving transistor; the second reset control sub-circuit includes a second transistor, a gate electrode of the second transistor is connected to the reset control terminal, and a first electrode of the second transistor is connected to the first initialization voltage input terminal, and a second electrode of the second transistor is connected to the common node; the third reset control sub-circuit includes a third transistor, a gate electrode of the third transistor is connected to the first control terminal, and a first electrode of the third transistor is connected to the second initialization voltage input terminal, and a second electrode of the third transistor is connected to the common node.

Optionally, the pixel driving circuit further includes: a second reset sub-circuit, respectively connected to the reset control terminal, the light-emitting element and a third initialization voltage input terminal; configured to control to connect or disconnect the third initialization voltage input terminal and the light-emitting element under the control of the reset control terminal.

Optionally, the third initialization voltage input terminal is coupled to the first initialization voltage input terminal.

Optionally, the second reset sub-circuit includes a fourth transistor, a gate electrode of the fourth transistor is connected to the reset control terminal, and a first electrode of the fourth transistor is connected to the third initialization voltage input terminal, and a second electrode of the fourth transistor is connected to the light emitting element.

Optionally, the pixel driving circuit further comprises a light-emitting control sub-circuit, and the second electrode of the driving transistor is connected to the light-emitting element through the light-emitting control sub-circuit; the light-emitting control sub-circuit is respectively connected to the first control terminal, the second electrode of the driving transistor and the light-emitting element, and configured to, under the control of the first control terminal, control to connect or disconnect the second electrode of the driving transistor and the light emitting element.

Optionally, the light-emitting control sub-circuit includes a fifth transistor, a gate electrode of the fifth transistor is connected to the first control terminal, and a first electrode of the fifth transistor is connected to the second electrode of the driving transistor, and a second electrode of the fifth transistor is connected to the light emitting element.

Optionally, the power control sub-circuit includes a sixth transistor, and a gate electrode of the sixth transistor is connected to the first control terminal, a first electrode of the sixth transistor is connected to the power signal input terminal, and a second electrode of the sixth transistor is connected to the first electrode of the driving transistor; the data writing-in sub-circuit includes a seventh transistor, a gate electrode of the seventh transistor is connected to the gate line of corresponding row, and the first electrode of the seventh transistor is connected to the data line of corresponding column, a second electrode of the seventh transistor is connected to the first electrode of the driving transistor; the compensation sub-circuit includes an eighth transistor, a gate electrode of the eighth transistor is connected to the gate line of corresponding row, and a first electrode of the eighth transistor is connected to the second electrode of the driving transistor, a second electrode of the eighth transistor is connected to the gate electrode of the driving transistor.

In a second aspect, a display device includes the pixel driving circuit.

Optionally, the display device includes a display area and a peripheral area surrounding the display area, and the display device further includes a first initialization signal lines and a second initialization signal line located in the peripheral area, the first initialization signal line and the second initialization signal line both extend along the first direction; the display device includes a plurality of the pixel driving circuits arranged in the display area in an array, and in each of pixel driving circuits located in the same row along the second direction, the first initialization voltage input terminal connected to the first reset sub-circuit is connected to the first initialization signal line Init1 through a same first connection line; in each of pixel driving circuits located in the same row along the second direction, the second initialization voltage input terminal connected to the first reset sub-circuit is connected to the second initialization signal line through a same second connection line, the first direction intersects the second direction.

In a third aspect, a method for driving the pixel driving circuit includes: in each working cycle, during a reset period, the first initialization voltage input terminal inputs the first initialization voltage, and under the control of the reset control terminal, the first reset sub-circuit controls to connect the first initialization voltage input terminal and the common node, and connect the common node and the gate electrode of the driving transistor in the driving sub-circuit; under the control of the first control terminal, the first reset sub-circuit controls to disconnect the second initialization voltage input terminal from the common node; during a writing-in compensation period, under the control of the reset control terminal, the first reset sub-circuit controls to disconnect the first initialization voltage input terminal from the common node, and controls to disconnect the common node from the gate electrode of the driving transistor; the data line of corresponding column inputs the data voltage Vdata, and under the control of the gate line of corresponding row, the data writing sub-circuit controls to connect the data line of corresponding column and the first electrode of the driving transistor, the compensation sub-circuit controls to connect the gate electrode of the driving transistor and the second electrode of the driving transistor, so that the driving transistor is formed into a diode structure, so that the potential of the gate electrode of the driving transistor becomes Vdata+Vth, and Vth is the threshold voltage of the driving transistor; during the light-emitting period, the power signal input terminal inputs the power voltage Vdd, and under the control of the first control terminal, the power control sub-circuit controls to connect the power signal input terminal and the first electrode of the driving transistor; under the control of the first control terminal, the first reset sub-circuit controls to connect the second initialization voltage input terminal and the common node; the difference between the potential of the second initialization signal inputted by the second initialization voltage input terminal and the potential of the gate electrode of the driving transistor during the light-emitting period is smaller than the threshold value.

Optionally, when the first reset sub-circuit includes a first reset control sub-circuit, a second reset control sub-circuit and a third reset control sub-circuit, during the reset period, under the control of the reset control terminal, the first reset control sub-circuit controls to connect the gate electrode of the driving transistor and the common node, and the second reset control sub-circuit controls to connect the common node and the first initialization voltage input terminal at the same time; under the control of the first control terminal, the third reset control sub-circuit controls to disconnect the common node from the second initialization voltage input terminal; during the writing-in compensation period, under the control of the reset control terminal, the first reset control sub-circuit controls to disconnect the gate electrode of the driving transistor from the common node, the second reset control sub-circuit controls to disconnect the common node from the first initialization voltage input terminal at the same time; during the light-emitting period, under the control of the first control terminal, the third reset control sub-circuit controls to connect the second initialization voltage input terminal and the common node.

Optionally, the pixel driving circuit further comprises a light-emitting control sub-circuit, and the second electrode of the driving transistor is connected to the light-emitting element through the light-emitting control sub-circuit; the light-emitting control sub-circuit is respectively connected to the first control terminal, the second electrode of the driving transistor and the light-emitting element; the driving method further includes: during the reset period and the writing-in compensation period, under the control of the first control terminal, the light-emitting control sub-circuit controls to disconnect the second electrode of the driving transistor from the light-emitting element, so that the light-emitting element does not emit light during the reset period and the writing-in compensation period.

Optionally, the pixel driving circuit further comprises a second reset sub-circuit, the second reset sub-circuit is respectively connected to the reset control terminal, the light-emitting element and the third initialization voltage input terminal; during the reset period, under the control of the reset control terminal, the second reset sub-circuit controls to connect the third initialization voltage input terminal and the light-emitting element.

Optionally, the potential of the third initialization signal inputted by the third initialization voltage input terminal is the same as the potential of the first initialization signal inputted by the first initialization voltage input terminal.

BRIEF DESCRIPTION OF THE DRAWINGS

The accompanying drawings described herein are used to provide further understanding of the present disclosure and constitute a part of the present disclosure. The exemplary embodiments of the present disclosure and their descriptions are used to explain the present disclosure and do not constitute an improper limitation of the present disclosure.

DETAILED DESCRIPTION

In order to further illustrate the pixel driving circuit, the method for driving the same, and the display device provided by the embodiments of the present disclosure, the following detailed description is given with reference to the accompanying drawings.

Figure 1:
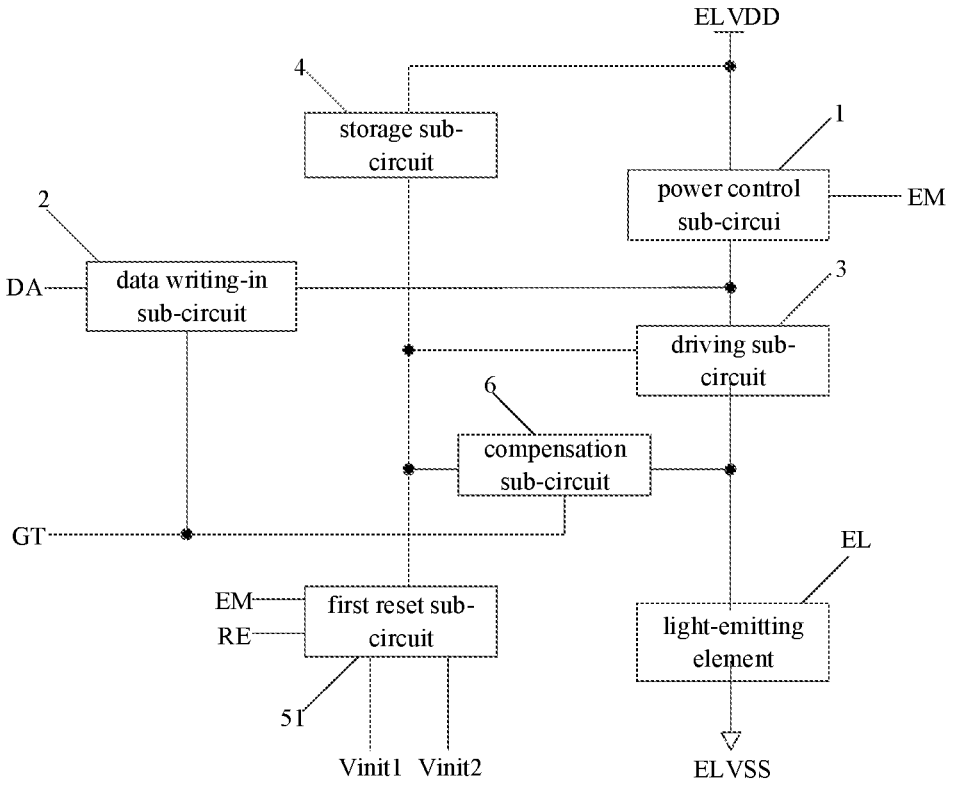
FIG. 1 is a schematic diagram of a first structure of a pixel driving circuit provided by an embodiment of the present disclosure.
Figure 2:
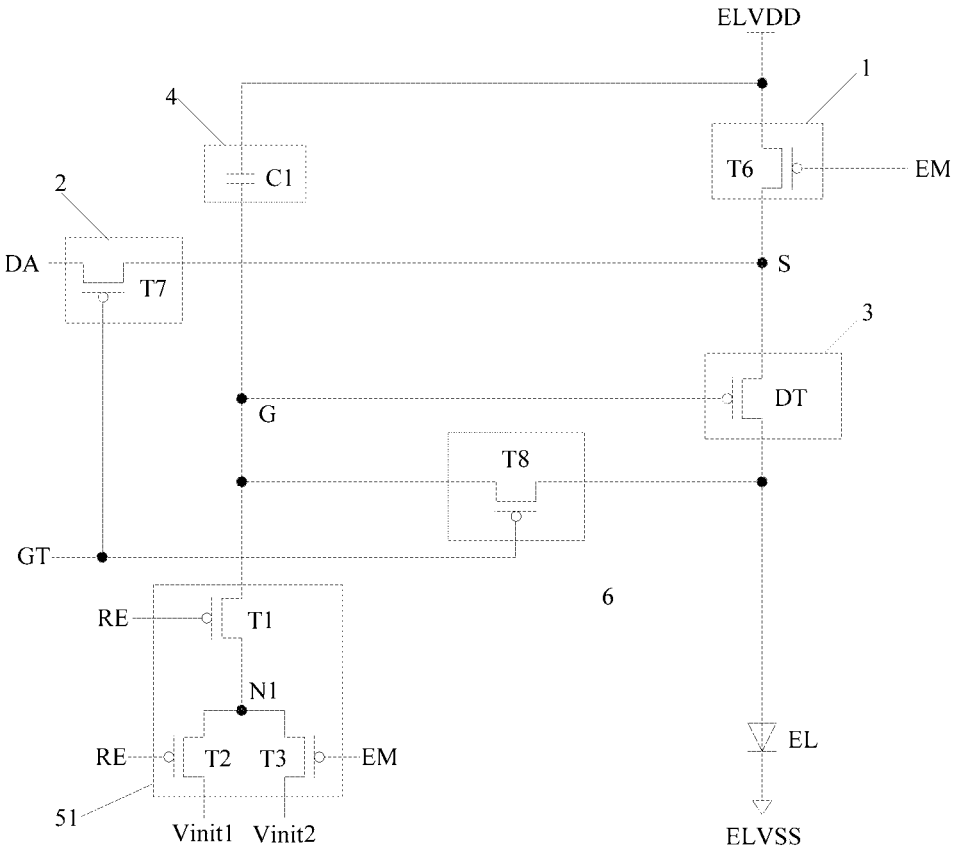
FIG. 2 is a first schematic circuit diagram of a pixel driving circuit provided by an embodiment of the present disclosure.

Referring to FIG. 1 and FIG. 2, an embodiment of the present disclosure provides a pixel driving circuit for driving a light-emitting element EL, and the pixel driving circuit includes:

- a driving sub-circuit 3, the driving sub-circuit 3 includes a driving transistor DT, and a second electrode of the driving transistor DT is connected to the light-emitting element EL;
- a storage sub-circuit 4, a first terminal of the storage sub-circuit 4 is connected to a gate electrode of the driving transistor DT (i.e. node G), and a second terminal of the storage sub-circuit 4 is connected to a power signal input terminal ELVDD;
- a power control sub-circuit 1, respectively connected with a first control terminal EM, a power signal input terminal ELVDD and a first electrode (i.e. the node S) of the driving transistor DT;
- a data writing-in sub-circuit 2, connected to a gate line GT of corresponding row, a data line DA of corresponding column and a first electrode of the driving transistor DT;
- a compensation sub-circuit 6, connected to the gate line GT of corresponding row, the gate electrode of the driving transistor DT and the second electrode of the driving transistor DT;
- a first reset sub-circuit 51, connected to a reset control terminal RE, a first control terminal EM, the gate electrode of the driving transistor DT, a common node N1, a first initialization voltage input terminal Vinit1 and a second initialization voltage input terminal Vinit2; configured to controls to connect or disconnect the gate electrode of the driving transistor DT and the common node N1 under the control of the reset control terminal RE, and controls to connect or disconnect the common node N1 and the first initialization voltage input terminal Vinit1; and controls to connect or disconnect the common node N1 and the second initialization voltage input terminal Vinit2 under the control of the first control terminal EM;
- a difference between a potential of a second initialization signal inputted by the second initialization voltage input terminal Vinit2 and a potential of the gate electrode of the driving transistor DT during a light-emitting period is smaller than a threshold value.

Specifically, the pixel driving circuit is applied to a display device, and the display device includes a substrate, a plurality of pixel driving circuits arranged on the substrate in an array, and the light-emitting elements EL arranged at a side of the plurality of pixel driving circuits away from the substrate and corresponding to the plurality of pixel driving circuits in a one-to-one manner. Exemplarily, the light-emitting element EL specifically includes an anode, a light-emitting functional layer, and a cathode that are sequentially stacked along a direction away from the substrate, and the anode of the light-emitting element EL can be connected to the corresponding pixel driving circuit and receive the driving signal provided by the pixel driving circuit, the cathode can be connected to the negative power signal line ELVSS in the display device, and receive the negative power signal provided by the negative power signal line, and the light-emitting functional layer is used to emit light under the combined action of the cathode and the anode.

It should be noted that the potential of the second initialization signal inputted by the second initialization voltage input terminal Vinit2 is approximately the same as the potential of the gate electrode of the driving transistor DT during the light-emitting period. Exemplarily, the difference between the potential of the second initialization signal inputted by the second initialization voltage input terminal Vinit2 and the potential of the gate electrode of the driving transistor DT during the light-emitting period is smaller than a threshold value. It is worth noting that the threshold value can be set according to actual needs. Exemplarily, the setting of the threshold value should satisfy the condition that the change amount of the current on the light-emitting element EL is less than 7% within one frame of display time.

Figure 9:
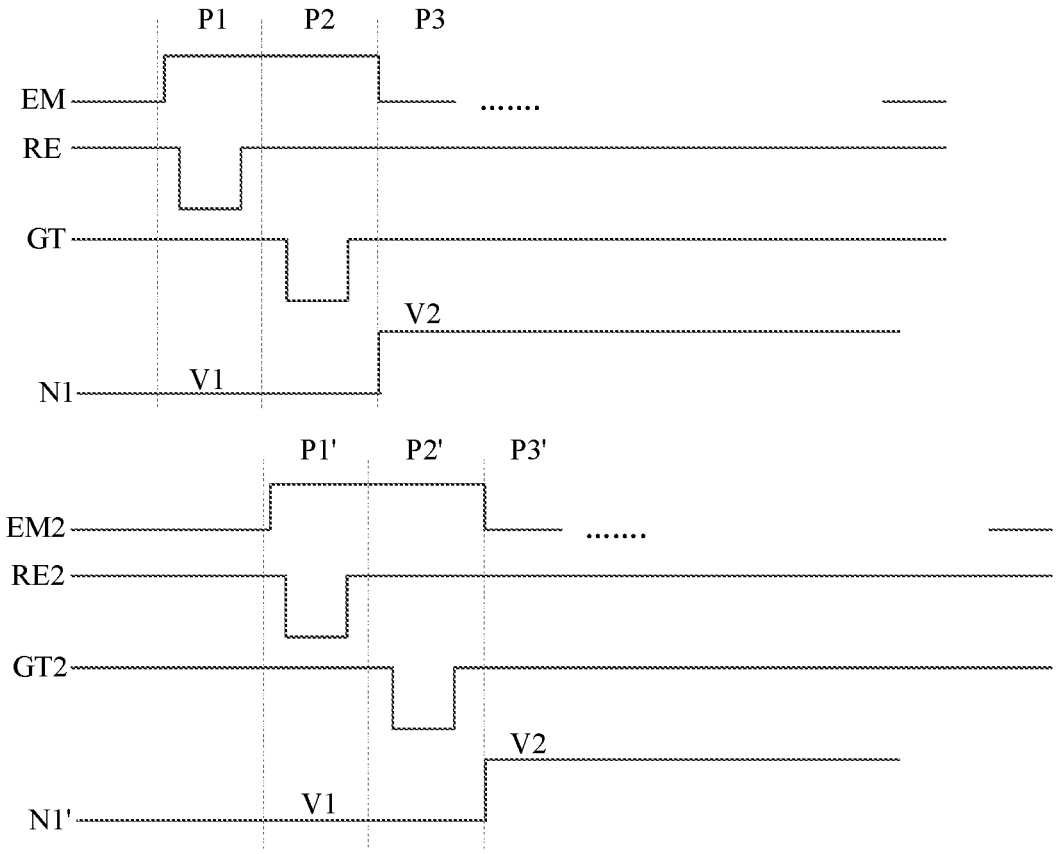
FIG. 9 is a driving timing sequence diagram of a pixel driving circuit according to an embodiment of the present disclosure.

Referring to FIG. 1, FIG. 2 and FIG. 9, the working process of the above pixel driving circuit in one driving cycle is:

During a reset period P1, the potential of the first initialization signal inputted by the first initialization voltage input terminal Vinit1 is V1, and the reset signal inputted by the reset control terminal RE is at an active level, so that under the control of the reset control terminal RE, the first reset sub-circuit 51 controls to connect the first initialization voltage input terminal Vinit1 and the common node N1, and controls to connect the common node N1 and the gate electrode of the driving transistor DT, so that the potential of the gate electrode of the driving transistor DT becomes V1, and the gate electrode of the driving transistor DT is reset, the gate-source voltage Vgs of the driving transistor DT in the previous frame is initialized; during the reset period P1, the first control signal inputted by the first control terminal EM is at an invalid level, so that under the control of the first control terminal EM, the first reset sub-circuit 51 also controls to disconnect the second initialization voltage input terminal Vinit2 from the common nodes N1.

During a writing-in compensation period P2, the reset signal inputted by the reset control terminal RE is at an invalide level, so that under the control of the reset control terminal RE, the first reset sub-circuit 51 controls to disconnect the first initialization voltage input terminal Vinit1 from the common node N1, controls to disconnect the common node N1 from the gate electrode of the driving transistor DT; under the control of the first control terminal EM, the first reset sub-circuit 51 continues to control to disconnect the second initialization voltage input terminal Vinit2 from the common node N1; the data voltage Vdata is inputted by the data line DA of corresponding column, and the scan signal inputted by the gate line GT of corresponding row is at a valid level, so that under the control of the gate line GT of corresponding row, the data writing-in sub-circuit 2 controls to connect the data line DA of corresponding column and the first electrode of the driving transistor DT, so that the potential of the first electrode of the driving transistor DT is changed to Vdata; at the same time, under the control of the gate line GT of corresponding row, the compensation sub-circuit 6 controls to connect the gate electrode of the driving transistor DT and the second electrode of the driving transistor DT, so that the driving transistor DT is formed into a diode structure, the data writing-in sub-circuit 2, the driving transistor DT and the compensation sub-circuit 6 work together to realize the threshold voltage compensation of the driving transistor DT. When the compensation time is long enough, the potential of the gate electrode of the driving transistor DT can finally reached Vdata+Vth, where Vth is the threshold voltage of the driving transistor DT.

During a light-emitting period P3, the power signal input terminal ELVDD inputs the power voltage Vdd, and the first control signal inputted by the first control terminal EM is at a valid level, so that under the control of the first control terminal EM, the power control sub-circuit 1 controls to connect the power signal input terminal ELVDD and the first electrode of the driving transistor DT, so that the potential of the first electrode of the driving transistor DT changes from Vdata to Vdd; the potential of the second initialization signal inputted by the second initialization voltage input terminals Vinit2 is V2. Under the control of the first control terminal EM, the first reset sub-circuit 51 controls to connect the second initialization voltage input terminal Vinit2 and the common nodes N1, so that the potential of the common node N1 becomes V2; the difference between the potential V2 of the second initialization signal inputted by the second initialization voltage input terminal Vinit2 and the potential of the gate electrode of the driving transistor DT during the light-emitting period P3 is less than the threshold value.

During the light-emitting period P3, the voltage Vgs between the gate electrode of the driving transistor DT and the first electrode of the driving transistor DT is:

$$Vgs=V\text{data}+Vth-Vdd, \quad \text{Formula (1)}$$

The driving current I generated when the driving transistor DT is turned on and works in a saturated state is:

$$I=k(Vgs-Vth)^2 \quad \text{Formula (2)}$$

Substitute formula (1) into formula (2) to get:

$$I=k(V\text{data}+Vth-Vdd-Vth)^2=k(V\text{data}-Vdd)^2 \quad \text{Formula (3)}$$

In formula (3), k is a constant.

It can be seen from the formula (3) that the driving current I is only related to the power voltage Vdd and the data voltage Vdata, is not related to the threshold voltage Vth of the driving transistor DT. When a same data voltage is inputted to a plurality of driving transistors DT with different threshold voltages Vth, the driving current generated when the driving transistors DT with different threshold voltages Vth work in the saturated state is the same, so that when the driving transistors DT with different threshold voltages Vth drive the corresponding light-emitting elements EL to emit light, the light-emitting elements EL have the same light-emitting brightness. When driving the light-emitting element EL to emit light by using the driving transistors DT with different threshold voltages Vth, the problem of uneven light-emitting brightness of the light-emitting element EL due to threshold voltage shift is avoided.

According to the specific structure and working process of the above-mentioned pixel driving circuit, in the pixel driving circuit provided by the embodiments of the present disclosure, by setting the first reset sub-circuit 51, the first reset sub-circuit 51 can connect the gate electrode of the driving transistor DT and the first initialization voltage input terminal Vinit1 during the reset period P1, so that the potential of the gate electrode of the driving transistor DT becomes a lower voltage V1 inputted by the first initialization voltage input terminal Vinit1, the gate electrode of the driving transistor D1 is reset. At the same time, during the reset period P1, the first reset sub-circuit 51 can disconnect the gate electrode of the driving transistor DT from the second initialization voltage input terminal Vinit2. During the light-emitting period P3, the first reset sub-circuit 51 can disconnect the gate electrode of the driving transistor DT from the first initialization voltage input terminal Vinit1, and connect the gate electrode of the driving transistor DT and the second initialization voltage input terminal Vinit2, so that the potential of the common node N1 is substantially the same as the potential of the gate electrode of the driving transistor DT.

Therefore, the pixel driving circuit provided by the embodiment of the present disclosure effectively reduces the leakage current of the gate electrode of the driving transistor DT through the first reset sub-circuit 51 during the light-emitting period P3, so that in the case of low-frequency driving, the potential of the gate electrode of the driving transistor DT can also be well maintained, the problem that the display device is prone to flicker during display is well improved. Therefore, the pixel driving circuit provided by the embodiments of the present disclosure not only ensures the display quality of the display device, but also reduces the power consumption of the display device in the case of low frequency driving.

In addition, the pixel driving circuit provided by the embodiment of the present disclosure can maintain the potential of the gate electrode of the driving transistor DT during the light-emitting period in case of both low-gray-scale display and high-gray-scale display, thereby improving the performance of the display device during the light-emitting period and avoiding the flickering when displaying.

It should be noted that FIG. 9 shows the driving timing sequences corresponding to the two rows of pixel driving circuits, wherein EM2 represents a first control terminal connected to the second row of pixel driving circuits, and RE2 represents the reset control terminal connected to the second row of pixel driving circuits, GT2 represents the gate line connected to the second row of the pixel driving circuits, and N1' represents the common node in the second row of pixel driving circuits. P1' represents the reset period corresponding to the second row of pixel driving circuits, P2' represents the writing-in compensation period corresponding to the second row of pixel driving circuits, and P3' represents the light-emitting period corresponding to the second row of pixel driving circuits.

Figure 3:
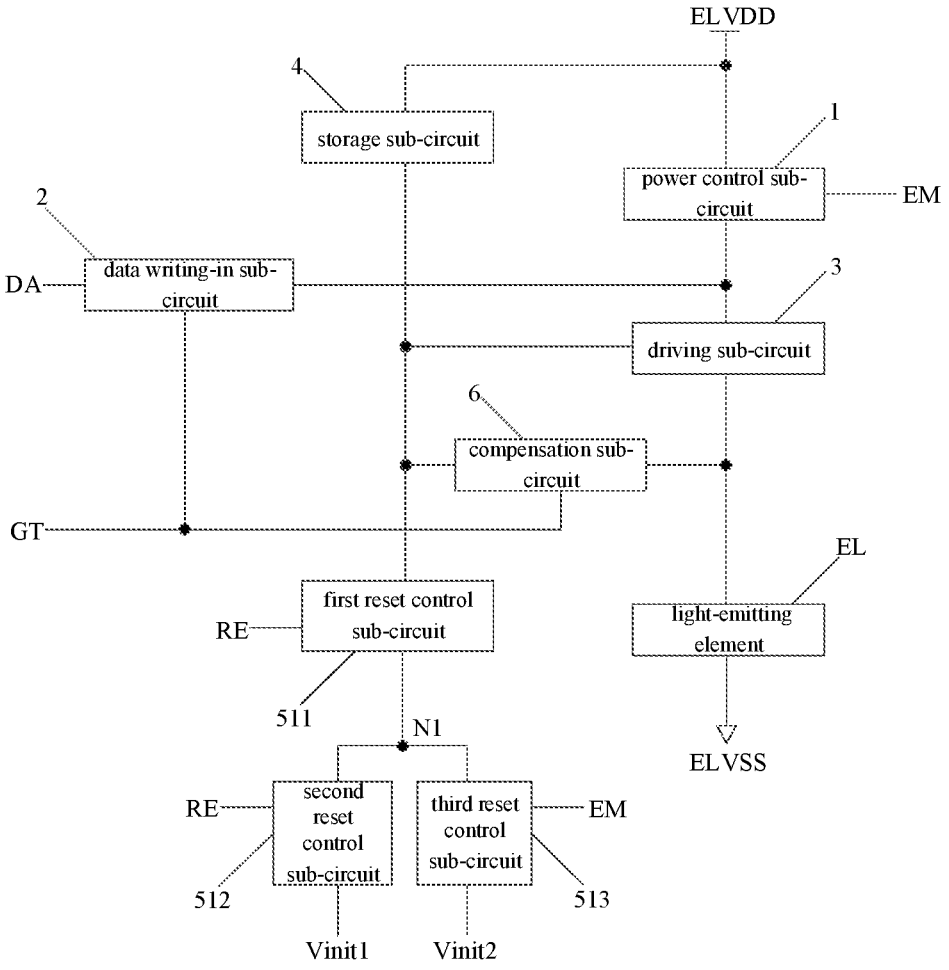
FIG. 3 is a schematic diagram of a second structure of a pixel driving circuit provided by an embodiment of the present disclosure.
Figure 4:
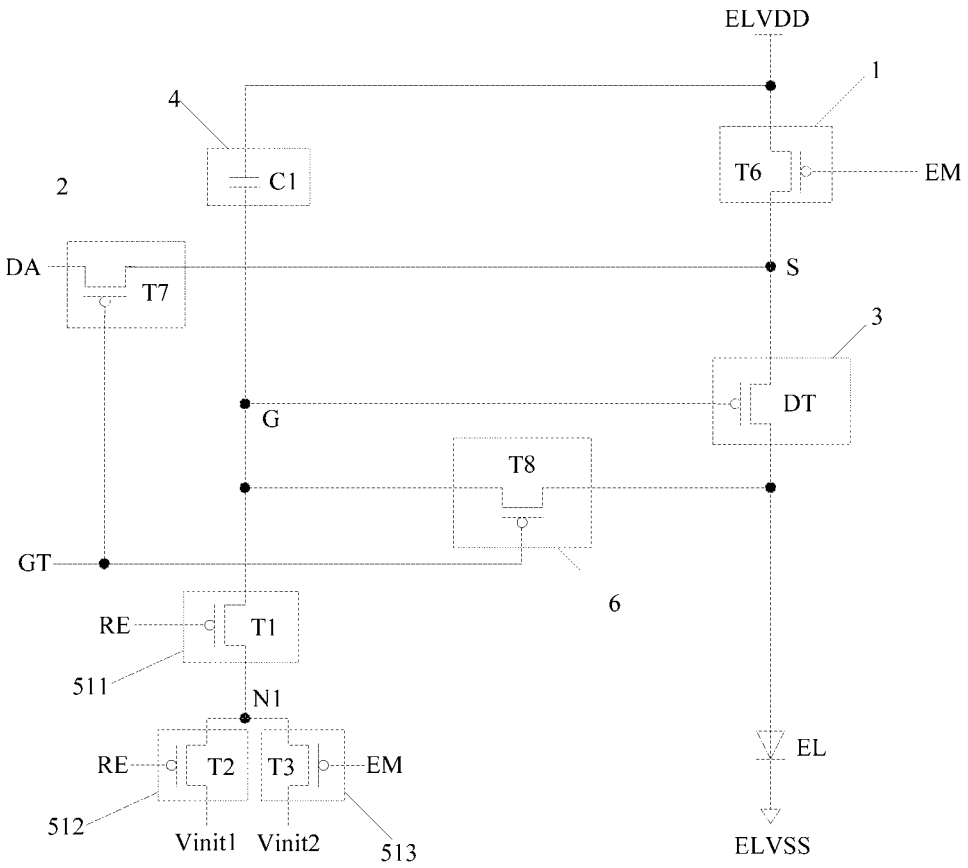
FIG. 4 is a second schematic circuit diagram of a pixel driving circuit according to an embodiment of the present disclosure.

As shown in FIG. 3 and FIG. 4, in some embodiments the first reset sub-circuit 51 includes:

- a first reset control sub-circuit 511, respectively connected to the reset control terminal RE, the gate electrode of the driving transistor DT and the common node N1; configured to control to connect or disconnect the gate electrode of the driving transistor DT and the common node N1 under the control of the reset control terminal RE;
- a second reset control sub-circuit 512, respectively connected to the reset control terminal RE, the common node N1 and the first initialization voltage input terminal Vinit1; configured to control to connect or disconnect the common node N1 and the first initialization voltage input terminal Vinit1 under the control of the reset control terminal RE;
- a third reset control sub-circuit 513, respectively connected to the first control terminal EM, the common node N1 and the second initialization voltage input terminal Vinit2; configured to control to connect or disconnect the common node N1 and the second initialization voltage input terminal Vinit2.

Specifically, the specific structure of the first reset sub-circuit 51 is various. Exemplarily, the first reset sub-circuit 51 includes a first reset control sub-circuit 511, a second reset control sub-circuit 512 and a third reset control sub-circuit 513, the first reset control sub-circuit 511 is connected between the gate electrode of the driving transistor DT and the common node N1, and the second reset control sub-circuit 512 is connected between the common node N1 and the first initialization voltage input terminal Vinit1, the third reset control sub-circuit 513 is connected between the common node N1 and the second initialization voltage input terminal Vinit2.

When the first reset sub-circuit 51 adopts the above structure, the working process of the first reset sub-circuit 51 is as follows:

During the reset period P1, under the control of the reset control terminal RE, the first reset control sub-circuit 511 controls to connect the gate electrode of the driving transistor DT and the common node N1, the second reset control sub-circuit 512 controls to connect the common node N1 and the first initialization voltage input terminal Vinit1, so that the potential of the gate electrode of the driving transistor DT is changed to V1, the gate electrode of the driving transistor DT is reset. The gate-source voltage Vgs on the driving transistor DT in the previous frame is initialized. Meanwhile, under the control of the first control terminal EM, the third reset control sub-circuit 513 controls to disconnect the common node N1 from the second initialization voltage input terminal Vinit2.

During the writing-in compensation period P2, under the control of the reset control terminal RE, the first reset control sub-circuit 511 controls to disconnect the gate electrode of the driving transistor DT from the common node N1, the second reset control sub-circuit 512 controls to disconnect the common node N1 from the first initialization voltage input terminal Vinit1. Meanwhile, under the control of the first control terminal EM, the third reset control sub-circuit 513 continues to control to disconnect the common node N1 from the second initialization voltage input terminal Vinit2.

During the light-emitting period P3, under the control of the reset control terminal RE, the first reset control sub-circuit 511 continues to control to disconnect the gate electrode of the driving transistor DT from the common node N1, and the second reset control sub-circuit 512 continues to control to disconnect the common node N1 from the first initialization voltage input terminal Vinit1. At the same time, under the control of the first control terminal EM, the third reset control sub-circuit 513 controls to connect the common node N1 and the second initialization voltage input terminal Vinit2, so that the potential of the common node N1 becomes V2 which is substantially the same as the potential of the gate electrode of the driving transistor DT.

It is worth noting that the reasons for the current leakage of the gate electrode of the driving transistor DT include: the potential of the initialization signal received by the first reset sub-circuit 51 during the light-emitting period P3 is low, so that there is a large potential difference between the potential of the gate electrode of the driving transistor DT and the potential of the initialization signal, thereby causing the gate electrode of the driving transistor DT to leak electricity to the initialization voltage input terminal for providing the initialization signal through the first reset sub-circuit 51.

In order to solve the current leakage problem caused by the above reasons, it can be considered to set the initialization signal inputted by the initialization voltage input terminal to an AC signal. During the light-emitting period, the potential of the initialization signal inputted by the initialization voltage input terminal is a low potential between −1V and −3V; during the light-emitting period, the potential of the initialization signal inputted by the initialization voltage input terminal is adjusted to be a high potential approximately the same as the potential of gate electrode of the driving transistor DT.

Although the above-mentioned method of setting the initialization signal inputted by the initialization voltage input terminal to an AC signal can improve the problem that the display device is prone to flicker during display, because the OLED driving structure is to emit light row by row, that is, the potential of the initialization signal inputted by the initialization voltage input terminal also needs to be adjusted row by row, so it is necessary to set a special GOA circuit for the initialization voltage input terminal corresponding to each row of pixel driving circuits, that is, a column of the GOA circuits is added to the display device, and the column of the GOA circuits occupy a large space, which is not conducive to the development requirements of the narrow frame of the display device.

In the pixel driving circuit provided by the embodiment, since the first initialization voltage input terminal Vinit1 and the second initialization voltage input terminal Vinit2 both input DC signals, the first control terminal EM can control the first reset sub-circuit 51 and the power control sub-circuit 1 at the same time. Therefore, the first control terminal EM connected to the first reset sub-circuit 51 and the power control sub-circuit 1 only needs one corresponding GOA circuit, the reset control terminal RE connected to the first reset sub-circuit 51 only needs one corresponding GOA circuit. Therefore, the pixel driving circuit provided in the above embodiment can use the existing GOA scheme to provide the common node N1 with an initialization signal with a suitable potential during different periods, and there is no need to add an additional GOA circuit dedicated to realizing the potential conversion of the initialization signal.

It should be noted that the existing GOA scheme includes a column of EMGOA and a column of GTGOA, wherein EMGOA is used to provide the first control signal to the first control terminal connected to the EMGOA, and GTGOA is used to provide a scan signal to the gate line connected to the GTGOA. The pixel driving circuit provided by the above-mentioned embodiment can use the existing one column of EMGOA and one column of GTGOA, and there is no need to add an additional GOA circuit specially used for realizing the potential conversion of the initialization signal.

Moreover, in the pixel driving circuit provided by the above embodiment, the first initialization voltage input terminal Vinit1 and the second initialization voltage input terminal Vinit2 both input DC signals, which avoids the increasing of power consumption caused by setting an AC initialization signal.

In some embodiments, the first reset control sub-circuit 511 includes a first transistor T1, a gate electrode of the first transistor T1 is connected to the reset control terminal RE, and a first electrode of the first transistor T1 is connected to the common node N1, and a second electrode of the first transistor T1 is connected to the gate electrode of the driving transistor DT;

The second reset control sub-circuit 512 includes a second transistor T2, a gate electrode of the second transistor T2 is connected to the reset control terminal RE, and a first electrode of the second transistor T2 is connected to the first initialization voltage input terminal Vinit1, and a second electrode of the second transistor T2 is connected to the common node N1;

The third reset control sub-circuit 513 includes a third transistor T3, a gate electrode of the third transistor T3 is connected to the first control terminal EM, and a first electrode of the third transistor T3 is connected to the second initialization voltage input terminal Vinit2, and a second electrode of the third transistor T3 is connected to the common node N1.

Specifically, the specific structures of the first reset control sub-circuit 511, the second reset control sub-circuit 512 and the third reset control sub-circuit 513 are various. The first reset control sub-circuit 511 includes a first transistor T1, the second reset control sub-circuit 512 includes a second transistor T2, and the third reset control sub-circuit 513 includes a third transistor T3.

During the reset period P1, the first transistor T1 and the second transistor T2 are turned on, and the third transistor T3 is turned off, thereby controlling to connect the first initialization voltage input terminal Vinit1 and the gate electrode of the driving transistor DT, and disconnect the second initialization voltage input terminal Vinit2 from the gate electrode of the driving transistor DT.

During the data writing-in period, the first transistor T1, the second transistor T2 and the third transistor T3 are all turned off, so as to control to disconnect the gate electrode of the driving transistor DT from the first initialization voltage input terminals Vinit1, and to disconnect the gate electrode of the driving transistor DT from the second initialization voltage input terminal Vinit2 at the same time.

During the light-emitting period P3, the first transistor T1 and the second transistor T2 are turned off, and the third transistor T3 is turned on, so as to control to disconnect the gate electrode of the driving transistor DT from the first initialization voltage input terminals Vinit1, and to connect the gate electrode of the driving transistor DT and the second initialization voltage input terminal Vinit2.

Figure 5:
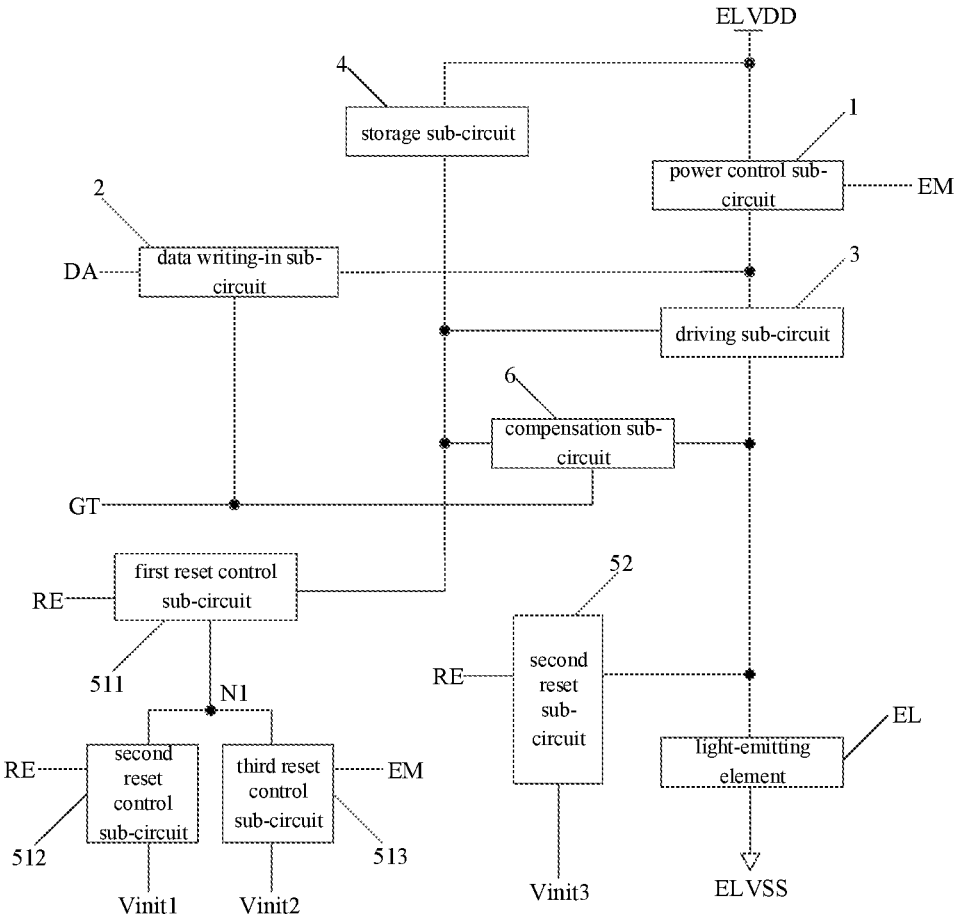
FIG. 5 is a schematic diagram of a third structure of a pixel driving circuit provided by an embodiment of the present disclosure.
Figure 6:
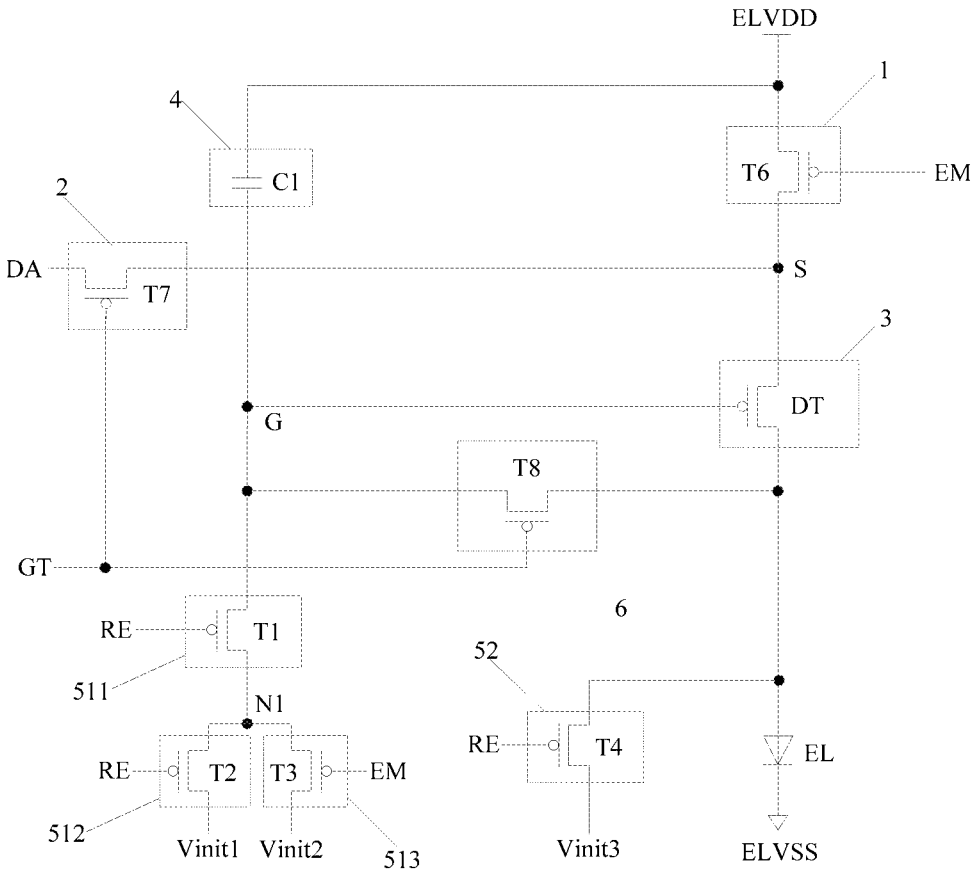
FIG. 6 is a third schematic circuit diagram of a pixel driving circuit provided by an embodiment of the present disclosure.

As shown in FIG. 5 and FIG. 6, in some embodiments, the pixel driving circuit further includes:

a second reset sub-circuit 52, respectively connected to the reset control terminal RE, the light-emitting element EL and a third initialization voltage input terminal Vinit3; configured to control to connect or disconnect the third initialization voltage input terminal Vinit3 and the light-emitting element EL under the control of the reset control terminal RE.

Specifically, during the reset period P1, under the control of the reset signal provided by the reset control terminal RE, the second reset sub-circuit 52 controls to connect the third initialization voltage input terminal Vinit3 and the light-emitting element EL, and the anode of the light-emitting element EL is reset by using the third initialization signal inputted by the third initialization voltage input terminal Vinit3.

During the writing-in compensation period P2 and the light-emitting period P3, under the control of the reset signal provided by the reset control terminal RE, the second reset sub-circuit 52 controls to disconnect the third initialization voltage input terminal Vinit3 from the light-emitting element EL.

As shown in FIG. 5 and FIG. 6, in some embodiments, the third initialization voltage input terminal Vinit3 is coupled to the first initialization voltage input terminal Vinit1.

Specifically, the third initialization signal inputted by the third initialization voltage input terminal Vinit3 is used to reset the anode of the light-emitting element EL, so the potential of the third initialization signal is low. The first initialization signal inputted by the first initialization voltage input terminal Vinit1 is also a signal used for reset, and also has a lower potential. Therefore, the third initialization voltage input terminal Vinit3 can be connected to the first initialization voltage input terminal Vinit1, so that only one initialization signal line that can provide an initialization signal with a lower potential for both the first initialization voltage input terminal Vinit1 and the third initialization voltage input terminal Vinit3 needs to be set in the display device. Therefore, in the pixel driving circuit provided by the above embodiment, by setting the third initialization voltage input terminal Vinit3 to be coupled to the first initialization voltage input terminal Vinit1, the number of initialization signal lines in the display device is effectively reduced, Therefore, it is more beneficial to reduce the layout difficulty of the display device.

As shown in FIG. 5 and FIG. 6, in some embodiments, the second reset sub-circuit 52 includes a fourth transistor T4, a gate electrode of the fourth transistor T4 is connected to the reset control terminal RE, and a first electrode of the fourth transistor T4 is connected to the third initialization voltage input terminal Vinit3, and a second electrode of the fourth transistor T4 is connected to the light emitting element EL.

Specifically, the specific structure of the second reset sub-circuit 52 is various. Exemplarily, the second reset sub-circuit 52 includes the fourth transistor T4.

During the reset period P1, under the control of the reset control terminal RE, the fourth transistor T4 is turned on, to control to connect the third initialization voltage input terminal Vinit3 and the light-emitting element EL, so as to realize the reset of the anode of the light-emitting element EL.

During the writing-in compensation period P2 and the light-emitting period P3, under the control of the reset control terminal RE, the fourth transistor T4 is turned off, thereby disconnecting the third initialization voltage input terminal Vinit3 from the light-emitting element EL.

Figure 7:
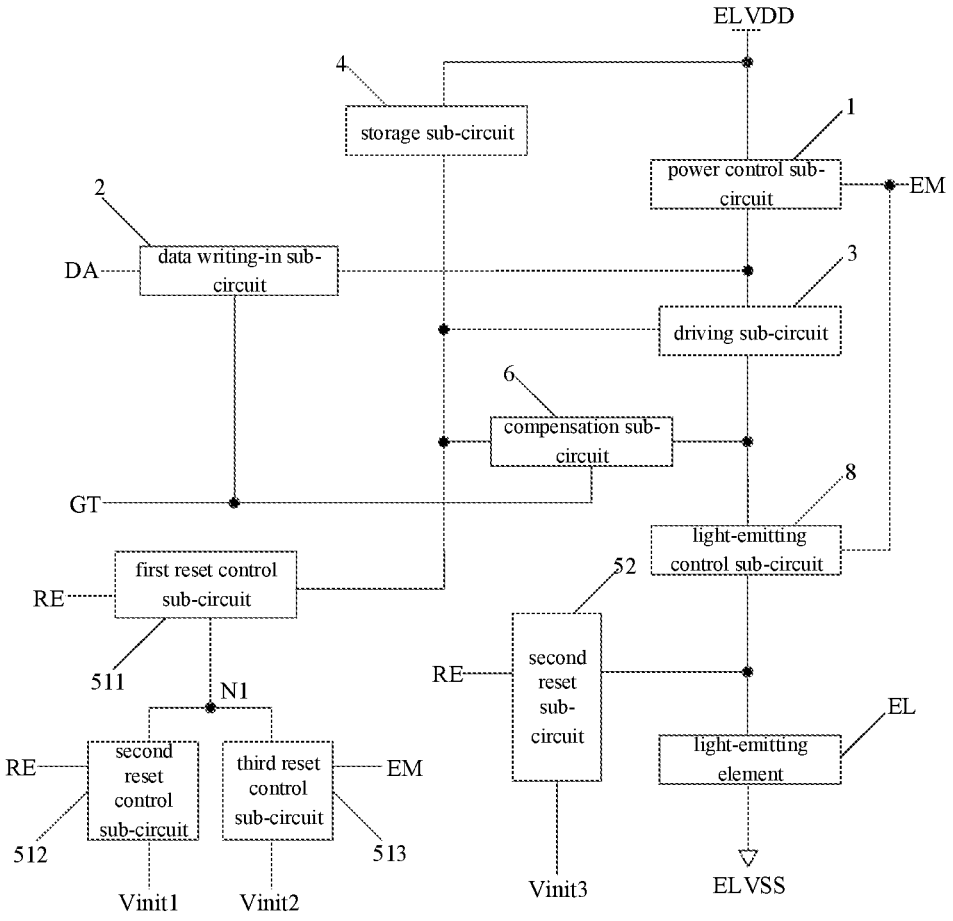
FIG. 7 is a schematic diagram of a fourth structure of a pixel driving circuit provided by an embodiment of the present disclosure.
Figure 8:
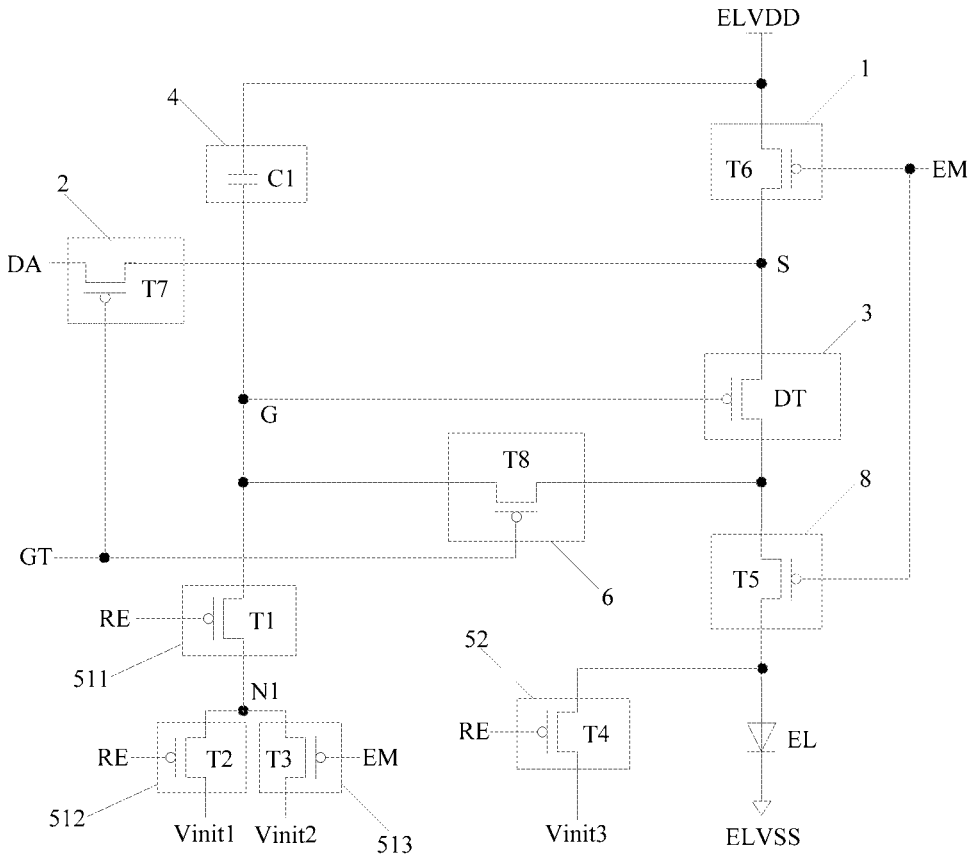
FIG. 8 is a fourth schematic circuit diagram of a pixel driving circuit provided by an embodiment of the present disclosure.

As shown in FIG. 7 and FIG. 8, in some embodiments, the pixel driving circuit further includes a light-emitting control sub-circuit 8, and the second electrode of the driving transistor DT is connected to the light-emitting element EL through the light-emitting control sub-circuit 8;

The light-emitting control sub-circuit 8 is respectively connected to the first control terminal EM, the second electrode of the driving transistor DT and the light-emitting element EL, and configured to, under the control of the first control terminal EM, control to connect or disconnect the second electrode of the driving transistor DT and the light emitting element EL.

Specifically, during the light-emitting period P3, under the control of the first control terminal EM, the light-emitting control sub-circuit 8 controls to connect the second electrode of the driving transistor DT and the anode of the light-emitting element EL.

During the reset period P1 and the writing-in compensation period P2, under the control of the first control terminal EM, the light-emitting control sub-circuit 8 controls to disconnect the second electrode of the driving transistor DT from the anode of the light-emitting element EL, so as to prevent the light-emitting element EL from emitting abnormally during the reset period P1 and the writing-in compensation period P2.

As shown in FIG. 7 and FIG. 8, in some embodiments, the light-emitting control sub-circuit 8 includes a fifth transistor T5, a gate electrode of the fifth transistor T5 is connected to the first control terminal EM, and a first electrode of the fifth transistor T5 is connected to the second electrode of the driving transistor DT, and a second electrode of the fifth transistor T5 is connected to the light emitting element EL.

Specifically, the specific structure of the light-emitting control sub-circuit 8 is various. Exemplarily, the light-emitting control sub-circuit 8 includes the fifth transistor T5.

During the light-emitting period P3, under the control of the first control terminal EM, the fifth transistor T5 is turned on, thereby controlling to connect the second electrode of the driving transistor DT and the anode of the light-emitting element EL.

During the reset period P1 and the writing-in compensation period P2, under the control of the first control terminal EM, the fifth transistor T5 is turned off, thereby controlling to disconnect the second electrode of the driving transistor DT from the anode of the light-emitting element EL, so as to prevent the light-emitting element EL from emitting light abnormally during the reset period P1 and the writing-in compensation period P2.

As shown in FIG. 7 and FIG. 8, in some embodiments, the power control sub-circuit 1 may include a sixth transistor T6, and a gate electrode of the sixth transistor T6 is connected to the first control terminal EM, a first electrode of the sixth transistor T6 is connected to the power signal input terminal, and a second electrode of the sixth transistor T6 is connected to the first electrode of the driving transistor DT;

The data writing-in sub-circuit 2 includes a seventh transistor T7, a gate electrode of the seventh transistor T7 is connected to the gate line GT of corresponding row, and the first electrode of the seventh transistor T7 is connected to the data line DA of corresponding column, a second electrode of the seventh transistor T7 is connected to the first electrode of the driving transistor DT;

The compensation sub-circuit 6 includes an eighth transistor T8, a gate electrode of the eighth transistor T8 is connected to the gate line GT of corresponding row, and a first electrode of the eighth transistor T8 is connected to the second electrode of the driving transistor DT, a second electrode of the eighth transistor T8 is connected to the gate electrode of the driving transistor DT.

The storage sub-circuit 4 includes a first capacitor C1.

Specifically, during the reset period P1, under the control of the first control terminal EM, the sixth transistor T6 is turned off, thereby controlling to disconnect the power signal input terminal ELVDD from the first electrode of the driving transistor DT; under the control of the gate line GT of corresponding row, the seventh transistor T7 is turned off, thereby controlling to disconnect the data line DA of corresponding column from the first electrode of the driving transistor DT; under the control of the gate line GT of corresponding row, the eighth transistor T8 is turned off, thereby controlling to disconnect the second electrode of the driving transistor DT from the gate electrode of the driving transistor DT.

During the writing-in compensation period P2, under the control of the first control terminal EM, the sixth transistor T6 is turned off, thereby controlling to disconnect the power signal input terminal ELVDD from the first electrode of the driving transistor DT, under the control of the gate line GT of corresponding row, the seventh transistor T7 is turned on, thereby controlling to connect the data line DA of corresponding column and the first electrode of the driving transistor DT; under the control of the gate line GT of corresponding row, the eighth transistor T8 is turned on, thereby controlling to connect the second electrode of the driving transistor DT and the gate electrode of the driving transistor DT.

During the light-emitting period P3, under the control of the first control terminal EM, the sixth transistor T6 is turned on, thereby controlling to connect the power signal input terminal ELVDD and the first electrode of the driving transistor DT; under the control of the gate line GT of corresponding row, the seventh transistor T7 is turned off, thereby controlling to disconnect the data line DA of corresponding column and the first electrode of the driving transistor DT; under the control of the gate line GT of corresponding row, the eighth transistor T8 is turned off, thereby controlling to disconnect t the second electrode of the driving transistor DT from the gate electrode of the driving transistor DT.

In the pixel driving circuit provided by the above-mentioned embodiment, each transistor is a PMOS transistor. Therefore, each transistor included in the pixel driving circuit can be prepared at the same time using the same process, which avoids complex processes used to simultaneously manufacture PMOS transistors and oxide transistors, which leads to the problem of a complicated manufacturing process and an increased manufacturing cost.

Embodiments of the present disclosure further provide a display device, including the pixel driving circuit provided by the above embodiments.

In the above-mentioned pixel driving circuit, the driving current I is only related to the power voltage Vdd and the data voltage Vdata, and is not related to the threshold voltage Vth of the driving transistor DT; when the same data voltage is inputted to a plurality of driving transistors DT with different threshold voltages Vth, the same driving current is generated when the driving transistors DT with different threshold voltages Vth is in the saturated state, the light-emitting elements EL have the same light-emitting brightness when the light-emitting element EL is driven to emit light by using the driving transistors DT with different threshold voltages Vth, so as to avoid the problem of uneven light-emitting of the light-emitting element EL due to threshold voltage shift.

In the pixel driving circuit provided by the above embodiment, by setting the first reset sub-circuit 51, during the reset period P1, the first reset sub-circuit 51 can connect the gate electrode of the driving transistor DT and the first initialization voltage input terminal Vinit1, so that the potential of the gate electrode of the driving transistor DT becomes the lower potential V1 inputted by the first initialization voltage input terminal Vinit1, so as to realize the reset of the gate electrode of the driving transistor DT. Meanwhile, during the reset period P1, the first reset sub-circuit 51 can disconnect the gate electrode of the driving transistor DT from the second initialization voltage input terminal Vinit2. During the light-emitting period P3, the first reset sub-circuit 51 can disconnect the gate electrode of the driving transistor DT from the first initialization voltage input terminal Vinit1, and connect the gate electrode of the driving transistor DT and the second initialization voltage input terminal Vinit2, so that the potential of the common node N1 is substantially the same as the potential of the gate electrode of the driving transistor DT. Therefore, the pixel driving circuit provided by the above embodiment effectively reduces the current leaked by the gate electrode of the driving transistor DT through the first reset sub-circuit 51 during the light-emitting period P3, so that in the case of low-frequency driving, the potential of the gate electrode of the driving transistor DT can be well maintained, so that the problem that the display device is prone to flicker during display is well improved. Therefore, the pixel driving circuit provided by the embodiments of the present disclosure not only ensures the display quality of the display device but also reduces the power consumption of the display device in case of low frequency driving.

When the display device provided by the embodiment of the present disclosure includes the pixel driving circuit provided by the above-mentioned embodiment, it also has the above-mentioned beneficial effects, which will not be repeated here.

It should be noted that the display device may be any product or component with a display function, such as a TV, a monitor, a digital photo frame, a mobile phone, and a tablet computer.

Figure 10:
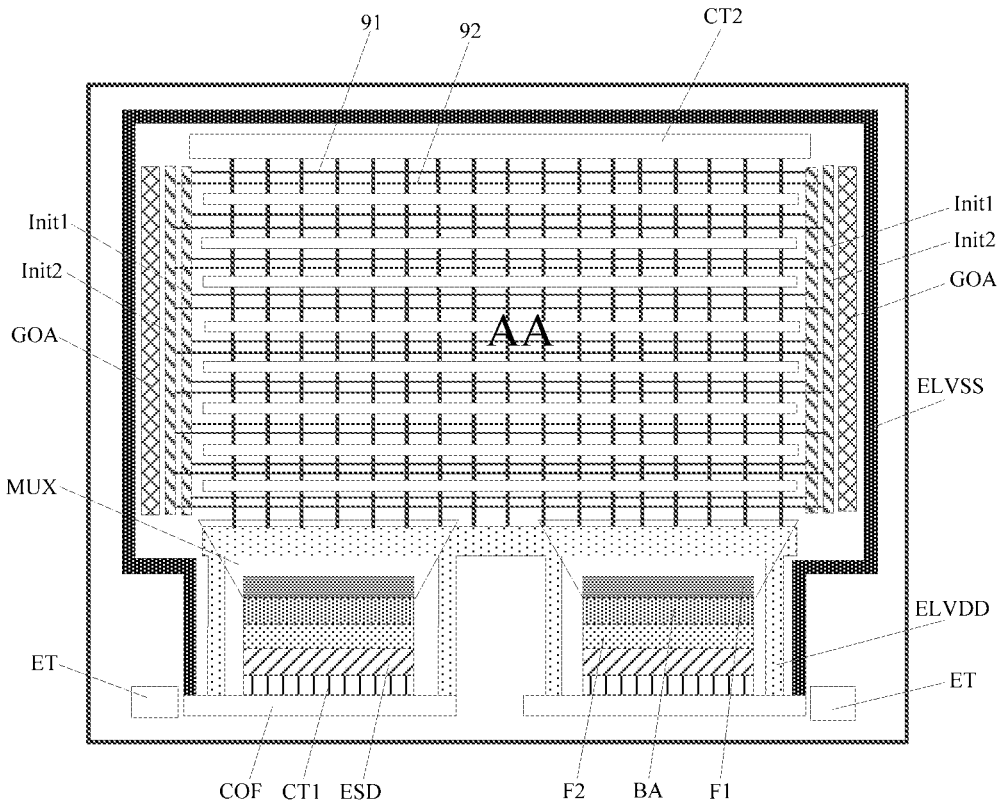
FIG. 10 is a schematic diagram of a layout of a display device according to an embodiment of the present disclosure.

As shown in FIG. 10, in some embodiments, the display device includes a display area AA and a peripheral area surrounding the display area AA, and the display device further includes a first initialization signal lines Init1 and a second initialization signal line Init2 located in the peripheral area, the first initialization signal line Init1 and the second initialization signal line Init2 both extend along the first direction;

The display device includes a plurality of the pixel driving circuits arranged in the display area AA in an array, and in each of pixel driving circuits located in the same row along the second direction, the first initialization voltage input terminal Vinit1 connected to the first reset sub-circuit 51 is connected to the first initialization signal line Init1 through a same first connection line 91;

In each of pixel driving circuits located in the same row along the second direction, the second initialization voltage input terminal Vinit2 connected to the first reset sub-circuit 51 is connected to the second initialization signal line Init2 through a same second connection line 92, the first direction intersects the second direction.

Specifically, the specific layout modes of the first initialization signal line Init1 and the second initialization signal line Init2 are various. Exemplarily, the first initialization signal line Init1 and the second initialization signal line Init2 are both arranged in the peripheral area, and the first initialization signal line Init1 and the second initialization signal line Init2 are disposed on opposite sides along the second direction.

Exemplarily, the first direction is the same as the extending direction of the data lines, and the second direction is the same as the extending direction of the gate lines.

Exemplarily, the first initialization signal line Init1 and the second initialization signal line Init2 are both made of the same material and made at the same layer, and the first initialization signal line Init1 and the second initialization signal line Init2 are arranged in sequence along the second direction.

Exemplarily, the first initialization signal line Init1 and the second initialization signal line Init2 are disposed at different layers, and an orthographic projection of the first initialization signal line Init1 on the substrate of the display device overlaps the orthographic projection of the second initialization signal line Init2 on the substrate of the display device.

Exemplarily, the first connection line 91 and the second connection line 92 are arranged at different layers.

When the first initialization signal line Init1 and the second initialization signal line Init2 are disposed in the peripheral area in the above manner, it is more beneficial to reduce the layout space occupied by the first initialization signal line Init1 and the second initialization signal line Init2. In the case of ensuring that the first initialization signal line Init1 and the second initialization signal line Init2 provide corresponding initialization signals for each pixel driving circuit in the display area AA, it is more conducive to the narrow frame of the display device.

It should be noted that a first fan-out area F1, a second fan-out area F2, a bending area BA, an electrostatic discharge unit ESD, a first test circuit CT1, a second test circuit CT2, a test circuit contact area ET, a chip-on-film (COF) and a multiplexer (MUX) are shown.

An embodiment of the present disclosure also provides a method for driving a pixel driving circuit provided in the above-mentioned embodiment, and the method includes: in each working cycle, During a reset period P1, the first initialization voltage input terminal Vinit1 inputs the first initialization voltage Vinit1, and under the control of the reset control terminal RE, the first reset sub-circuit 51 controls to connect the first initialization voltage input terminal Vinit1 and the common node N1, and connect the common node N1 and the gate electrode of the driving transistor DT in the driving sub-circuit; under the control of the first control terminal EM, the first reset sub-circuit 51 controls to disconnect the second initialization voltage input terminal Vinit2 from the common node N1;

During a writing-in compensation period P2, under the control of the reset control terminal RE, the first reset sub-circuit 51 controls to disconnect the first initialization voltage input terminal Vinit1 from the common node N1, and controls to disconnect the common node N1 from the gate electrode of the driving transistor DT; the data line DA of corresponding column inputs the data voltage Vdata, and under the control of the gate line GT of corresponding row, the data writing sub-circuit 2 controls to connect the data line DA of corresponding column and the first electrode of the driving transistor DT, the compensation sub-circuit 6 controls to connect the gate electrode of the driving transistor DT and the second electrode of the driving transistor DT, so that the driving transistor DT is formed into a diode structure, so that the potential of the gate electrode of the driving transistor DT becomes Vdata+Vth, and Vth is the threshold voltage of the driving transistor DT;

During the light-emitting period P3, the power signal input terminal ELVDD inputs the power voltage Vdd, and under the control of the first control terminal EM, the power control sub-circuit 1 controls to connect the power signal input terminal ELVDD and the first electrode of the driving transistor DT; under the control of the first control terminal EM, the first reset sub-circuit 51 controls to connect the second initialization voltage input terminal Vinit2 and the common node N1; the difference between the potential of the second initialization signal inputted by the second initialization voltage input terminal Vinit2 and the potential of the gate electrode of the driving transistor DT during the light-emitting period P3 is smaller than the threshold value.

When the pixel driving circuit is driven by the above method, the working process in one driving cycle is as follows:

During the reset period P1, the potential of the first initialization signal inputted by the first initialization voltage input terminal Vinit1 is V1, and the reset signal inputted by the reset control terminal RE is at a valid level, so that under the control of the reset control terminal RE, the first reset sub-circuit 51 controls to connect the first initialization voltage input terminal Vinit1 and the common node N1, and to connect the common node N1 and the gate electrode of the driving transistor DT, so that the potential of the gate electrode of the driving transistor DT becomes V1, and the gate electrode of the driving transistor DT is reset, so that the gate-source voltage Vgs on the driving transistor DT in the previous frame is initialized; during the reset period P1, the first control signal inputted by the first control terminal EM is at an invalide level, so that under the control of the first control terminal EM, the first reset sub-circuit 51 also controls to disconnect the second initialization voltage input terminal Vinit2 from the common nodes N1.

During the writing-in compensation period P2, the reset signal inputted by the reset control terminal RE is at an invalid level, that under the control of the reset control terminal RE, the first reset sub-circuit 51 controls to disconnect the first initialization voltage input terminal Vinit1 from the common node N1, controls to disconnect the common node N1 from the gate electrode of the driving transistor DT; under the control of the first control terminal EM, the first reset sub-circuit 51 continues to control to disconnect the second initialization voltage input terminal Vinit2 from the common node N1; the data voltage Vdata is inputted by the data line DA of corresponding column, and the scan signal inputted by the gate line GT of corresponding row is at a valid level, so that under the control of the gate line GT of corresponding row, the data writing-in sub-circuit 2 controls to connect the data line DA of corresponding column and the first electrode of the driving transistor DT, so that the potential of the first electrode of the driving transistor DT is Vdata; at the same time, under the control of the gate line GT of corresponding row, the compensation sub-circuit 6 controls to connect the gate electrode of the driving transistor DT and the second electrode of the driving transistor DT, so that the driving transistor DT is formed into a diode structure, the data writing-in sub-circuit 2, the driving transistor DT and the compensation sub-circuit 6 work together to realize the threshold voltage compensation of the driving transistor DT. When the compensation time is long enough, the potential of the gate electrode of the driving transistor DT can finally reach Vdata+Vth, where Vth is the threshold voltage of the driving transistor DT.

During the light-emitting period P3, the power signal input terminal ELVDD inputs the power voltage Vdd, and the first control signal inputted by the first control terminal EM is at a valid level, so that under the control of the first control terminal EM, the power control sub-circuit 1 controls to connect the power signal input terminal ELVDD and the first electrode of the driving transistor DT, so that the potential of the first electrode of the driving transistor DT changes from Vdata to Vdd; the potential of the second initialization signal inputted by the second initialization voltage input terminals Vinit2 is V2. Under the control of the first control terminal EM, the first reset sub-circuit 51 controls to connect the second initialization voltage input terminal Vinit2 and the common nodes N1, so that the potential of the common node N1 become V2; the difference between the potential V2 of the second initialization signal inputted by the second initialization voltage input terminal Vinit2 and the potential of the gate electrode of the driving transistor DT during the light-emitting period P3 is less than the threshold value.

When using the method provided by the embodiment of the present disclosure to drive the pixel driving circuit provided by the above embodiment, the driving current I is only related to the power voltage Vdd and the data voltage Vdata, is not related to the threshold voltage Vth of the driving transistor DT, when the same data voltage is inputted to a plurality of driving transistors DT with different threshold voltages Vth, the same driving current is generated when the driving transistors DT with different threshold voltages Vth are in the saturated state, the light-emitting elements EL have the same light-emitting brightness when the light-emitting element EL is driven to emit light by using the driving transistors DT with different threshold voltages Vth, so as to avoid the problem of uneven light-emitting of the light-emitting element EL due to threshold voltage shift.

When the above-mentioned pixel driving circuit is driven by the method provided by the embodiment of the present disclosure, during the reset period P1, the first reset sub-circuit 51 can connect the gate electrode of the driving transistor DT and the first initialization voltage input terminal Vinit1, so that the potential of the gate electrode of the driving transistor DT change to a lower potential V1 inputted by the first initialization voltage input terminal Vinit1, so as to realize the reset of the gate electrode of the driving transistor DT; at the same time, during the reset period P1, the first reset sub-circuit 51 can disconnect the gate electrode of the driving transistor DT from the second initialization voltage input terminal Vinit2. During the light-emitting period P3, the first reset sub-circuit 51 can disconnect the gate electrode of the driving transistor DT from the first initialization voltage input terminal Vinit1, and connect the gate electrode of the driving transistor DT and the second initialization voltage input terminal Vinit2, so that the potential of the common node N1 is substantially the same as the potential of the gate electrode of the driving transistor DT.

Therefore, using the method provided by the embodiment of the present disclosure to drive the above-mentioned pixel driving circuit, the leakage current of the gate electrode of the driving transistor DT through the first reset sub-circuit 51 during the light-emitting period P3 is effectively reduced, so that in the case of low frequency driving, the potential of the gate electrode of the driving transistor DT can also be well maintained, so that the problem that the display device is prone to flicker during display is well improved. Therefore, the pixel driving circuit provided by the embodiments of the present disclosure not only ensures the display quality of the display device but also reduces the power consumption of the display device in case of low frequency driving.

In some embodiments, when the first reset sub-circuit includes a first reset control sub-circuit 511, a second reset control sub-circuit 512 and a third reset control sub-circuit 513, During the reset period P1, under the control of the reset control terminal RE, the first reset control sub-circuit 511 controls to connect the gate electrode of the driving transistor DT and the common node N1, and the second reset control sub-circuit 512 controls to connect the common node N1 and the first initialization voltage input terminal Vinit1 at the same time; under the control of the first control terminal EM, the third reset control The sub-circuit 513 controls to disconnect the common node N1 from the second initialization voltage input terminal Vinit2;

During the writing-in compensation period P2, under the control of the reset control terminal RE, the first reset control sub-circuit 511 controls to disconnect the gate electrode of the driving transistor DT from the common node N1, the second reset control sub-circuit 512 controls to disconnect the common node N1 from the first initialization voltage input terminal Vinit1 at the same time;

During the light-emitting period P3, under the control of the first control terminal EM, the third reset control sub-circuit 513 controls to connect the second initialization voltage input terminal Vinit2 and the common node N1.

Specifically, during the reset period P1, under the control of the reset control terminal RE, the first reset control sub-circuit 511 controls to connect the gate electrode of the driving transistor DT and the common node N1, the second reset control sub-circuit 512 controls to connect the common node N1 and the first initialization voltage input terminal Vinit1, so that the potential of the gate electrode of the driving transistor DT becomes V1, so as to realize the reset of the gate electrode of the driving transistor DT, so that the gate-source voltage Vgs on the driving transistor DT in the previous frame is initialized. Meanwhile, under the control of the first control terminal EM, the third reset control sub-circuit 513 controls to disconnect the common node N1 from the second initialization voltage input terminal Vinit2.

During the writing-in compensation period P2, under the control of the reset control terminal RE, the first reset control sub-circuit 511 controls to disconnect the gate electrode of the driving transistor DT from the common node N1, the second reset control sub-circuit 512 controls to disconnect the common node N1 from the first initialization voltage input terminal Vinit1. Meanwhile, under the control of the first control terminal EM, the third reset control sub-circuit 513 continues to control to disconnect the common node N1 from the second initialization voltage input terminal Vinit2.

During the light-emitting period P3, under the control of the reset control terminal RE, the first reset control sub-circuit 511 continues to control to disconnect the gate electrode of the driving transistor DT from the common node N1, and the second reset control sub-circuit 512 continues to control to disconnect the common node N1 from the first initialization voltage input terminal Vinit1. At the same time, under the control of the first control terminal EM, the third reset control sub-circuit 513 controls to connect the common node N1 and the second initialization voltage input terminal Vinit2, so that the potential of the common node N1 becomes V2 which is substantially the same as the potential of the gate electrode of the driving transistor DT.

When the pixel driving circuit is driven by the method provided in the above embodiment, since the first initialization voltage input terminal Vinit1 and the second initialization voltage input terminal Vinit2 both input DC signals, the first control terminal EM can not only control the first reset sub-circuit 51, but also control the power control sub-circuit 1 at the same time. Therefore, the first control terminal EM connected to the first reset sub-circuit 51 and the power control sub-circuit 1 only needs to set one corresponding GOA circuit, the reset control terminal RE connected to the first reset sub-circuit 51 only needs to set one corresponding GOA circuit. Therefore, when using the method provided in the above embodiment to drive the pixel driving circuit, the existing GOA scheme can be used to provide the common node N1 with an initialization signal with a suitable potential at different time periods, without adding an additional GOA circuit dedicated to realizing the potential conversion of the initialization signal.

Moreover, when the pixel driving circuit is driven by the method provided in the above embodiment, the first initialization voltage input terminal Vinit1 and the second initialization voltage input terminal Vinit2 both input DC signals, which avoids the increasing of the power consumption due to setting the AC initialization signal.

In some embodiments, the pixel driving circuit further includes a light-emitting control sub-circuit 8, and the second electrode of the driving transistor DT is connected to the light-emitting element EL through the light-emitting control sub-circuit 8; the light-emitting control sub-circuit 8 is respectively connected to the first control terminal EM, the second electrode of the driving transistor DT and the light-emitting element EL; the driving method further includes: during the reset period P1 and the writing-in compensation period P2, under the control of the first control terminal EM, the light-emitting control sub-circuit 8 controls to disconnect the second electrode of the driving transistor DT from the light-emitting element EL, so that the light-emitting element EL does not emit light during the reset period P1 and the writing-in compensation period P2.

Specifically, during the light-emitting period P3, under the control of the first control terminal EM, the light-emitting control sub-circuit 8 controls to connect the second electrode of the driving transistor DT and the anode of the light-emitting element EL.

During the reset period P1 and the writing-in compensation period P2, under the control of the first control terminal EM, the light-emitting control sub-circuit 8 controls to disconnect the second electrode of the driving transistor DT from the anode of the light-emitting element EL, so as to prevent the light-emitting element EL from emitting abnormally during the reset period P1 and the writing-in compensation period P2.

In some embodiments, the pixel driving circuit further includes a second reset sub-circuit 52, the second reset sub-circuit 52 is respectively connected to the reset control terminal RE, the light-emitting element EL and the third initialization voltage input terminal Vinit3; during the reset period P1, under the control of the reset control terminal RE, the second reset sub-circuit 52 controls to connect the third initialization voltage input terminal Vinit3 and the light-emitting element EL.

Specifically, during the reset period P1, under the control of the reset signal provided by the reset control terminal RE, the second reset sub-circuit 52 controls to connect the third initialization voltage input terminal Vinit3 and the light-emitting element EL, and the anode of the light-emitting element EL is reset by using the third initialization signal inputted by the third initialization voltage input terminal Vinit3.

During the writing-in compensation period P2 and the light-emitting period P3, under the control of the reset signal provided by the reset control terminal RE, the second reset sub-circuit 52 controls to disconnect the third initialization voltage input terminal Vinit3 from the light-emitting element EL.

In some implementations, the potential of the third initialization signal inputted by the third initialization voltage input terminal Vinit3 can be set to be the same as the potential of the first initialization signal inputted by the first initialization voltage input terminal Vinit1.

Specifically, the third initialization signal inputted by the third initialization voltage input terminal Vinit3 is used to reset the anode of the light-emitting element EL, so the potential of the third initialization signal is low. The first initialization signal inputted by the first initialization voltage input terminal Vinit1 is also a signal used for reset, and also has a lower potential. Therefore, the third initialization voltage input terminal Vinit3 can be connected to the first initialization voltage input terminal Vinit1, so that the display device only needs to be provided with one initialization signal line capable of simultaneously providing the same initialization signal with a lower potential for the first initialization voltage input terminal Vinit1 and the third initialization voltage input terminal Vinit3. Therefore, when the pixel driving circuit is driven by the method provided in the above embodiment, the number of initialization signal lines in the display device can be effectively reduced, thereby further reducing the layout difficulty of the display device.

It should be noted that the various embodiments in this specification are described in a progressive manner, and the same or similar parts among the various embodiments can be referred to each other, and each embodiment focuses on the differences from other embodiments. In particular, for the method embodiment, since it is basically similar to the product embodiment, the description is relatively simple, and the relevant part can be referred to the description of the product embodiment.

Unless otherwise defined, the technical or scientific terms used in the present disclosure shall have the usual meanings understood by those with ordinary skills in the field to which this disclosure belongs. The "first", "second" and similar words used in the present disclosure do not indicate any order, quantity or importance, but are only used to distinguish different components. The word "include" or "comprise" and other similar words mean that the element or item appearing before the word encompasses the element or item listed after the word and its equivalents, but does not exclude other elements or items. Similar words such as "connected" or "coupled" are not limited to physical or mechanical connections, but may include electrical connections, whether direct or indirect. "Up", "Down", "Left", "Right", etc. are only used to indicate the relative position relationship. When the absolute position of the described object changes, the relative position relationship may also change accordingly.

It will be understood that when an element such as a layer, film, area or substrate is referred to as being "on" or "under" another element, it can be "directly on" or "under" the other element, or an intermediate element may be present.

In the foregoing description of the embodiments, the particular features, structures, materials or characteristics may be combined in any suitable manner in any one or more of the embodiments or examples.

The above are the preferred embodiments of the present disclosure. Obviously, a person skilled in the art may make further modifications and improvements without departing from the principle of the present disclosure, and these modifications and improvements shall also fall within the scope of the present disclosure.

What is claimed is:

1. A pixel driving circuit for driving a light-emitting element, comprising:

a driving sub-circuit, wherein the driving sub-circuit includes a driving transistor, and a second electrode of the driving transistor is connected to the light-emitting element;

a storage sub-circuit, wherein a first terminal of the storage sub-circuit is connected to a gate electrode of the driving transistor, and a second terminal of the storage sub-circuit is connected to a power signal input terminal;

a power control sub-circuit, connected to a first control terminal, the power signal input terminal and a first electrode of the driving transistor;

a data writing-in sub-circuit, connected to a gate line of corresponding row, a data line of corresponding column and a first electrode of the driving transistor;

a compensation sub-circuit, connected to the gate line of corresponding row, the gate electrode of the driving transistor and the second electrode of the driving transistor;

a first reset sub-circuit, connected to a reset control terminal, the first control terminal, the gate electrode of the driving transistor, a common node, a first initialization voltage input terminal and a second initialization voltage input terminal; configured to controls to connect or disconnect the gate electrode of the driving transistor and the common node under the control of the reset control terminal, and controls to connect or disconnect the common node and the first initialization voltage input terminal; and controls to connect or disconnect the common node and the second initialization voltage input terminal under the control of the first control terminal, wherein the first reset sub-circuit comprises:

a first reset control sub-circuit, connected to the reset control terminal, the gate electrode of the driving transistor and the common node; configured to control to connect or disconnect the gate electrode of the driving transistor and the common node under the control of the reset control terminal;

a second reset control sub-circuit, connected to the reset control terminal, the common node and the first initialization voltage input terminal; configured to control to connect or disconnect the common node and the first initialization voltage input terminal under the control of the reset control terminal;

a third reset control sub-circuit, connected to the first control terminal, the common node and the second initialization voltage input terminal; configured to control to connect or disconnect the common node and the second initialization voltage input terminal under the control of the first control terminal.

2. The pixel driving circuit according to claim 1, wherein, the first reset control sub-circuit includes a first transistor, a gate electrode of the first transistor is connected to the reset control terminal, and a first electrode of the first transistor is connected to the common node, and a second electrode of the first transistor is connected to the gate electrode of the driving transistor;

the second reset control sub-circuit includes a second transistor, a gate electrode of the second transistor is connected to the reset control terminal, and a first electrode of the second transistor is connected to the first initialization voltage input terminal, and a second electrode of the second transistor is connected to the common node;

the third reset control sub-circuit includes a third transistor, a gate electrode of the third transistor is connected to the first control terminal, and a first electrode of the third transistor is connected to the second initialization voltage input terminal, and a second electrode of the third transistor is connected to the common node.

3. The pixel driving circuit according to claim 1, wherein the pixel driving circuit further comprises:

a second reset sub-circuit, connected to the reset control terminal, the light-emitting element and a third initialization voltage input terminal; configured to control to connect or disconnect the third initialization voltage input terminal and the light-emitting element under the control of the reset control terminal.

4. The pixel driving circuit according to claim 3, wherein the third initialization voltage input terminal is coupled to the first initialization voltage input terminal.

5. The pixel driving circuit according to claim 3, wherein the second reset sub-circuit includes a fourth transistor, a gate electrode of the fourth transistor is connected to the reset control terminal, and a first electrode of the fourth transistor is connected to the third initialization voltage input terminal, and a second electrode of the fourth transistor is connected to the light emitting element.

6. The pixel driving circuit according to claim 1, wherein the pixel driving circuit further comprises a light-emitting control sub-circuit, and the second electrode of the driving transistor is connected to the light-emitting element through the light-emitting control sub-circuit;

the light-emitting control sub-circuit is connected to the first control terminal, the second electrode of the driving transistor and the light-emitting element, and configured to, under the control of the first control terminal, control to connect or disconnect the second electrode of the driving transistor and the light emitting element.

7. The pixel driving circuit according to claim 6, wherein the light-emitting control sub-circuit includes a fifth transistor, a gate electrode of the fifth transistor is connected to the first control terminal, and a first electrode of the fifth transistor is connected to the second electrode of the driving transistor, and a second electrode of the fifth transistor is connected to the light emitting element.

8. A pixel driving circuit for driving a light-emitting element, comprising:

a driving sub-circuit, wherein the driving sub-circuit includes a driving transistor, and a second electrode of the driving transistor is connected to the light-emitting element;

a storage sub-circuit, wherein a first terminal of the storage sub-circuit is connected to a gate electrode of the driving transistor, and a second terminal of the storage sub-circuit is connected to a power signal input terminal;

a power control sub-circuit, connected to a first control terminal, the power signal input terminal and a first electrode of the driving transistor;

a data writing-in sub-circuit, connected to a gate line of corresponding row, a data line of corresponding column and a first electrode of the driving transistor;

a compensation sub-circuit, connected to the gate line of corresponding row, the gate electrode of the driving transistor and the second electrode of the driving transistor;

a first reset sub-circuit, connected to a reset control terminal, the first control terminal, the gate electrode of the driving transistor, a common node, a first initialization voltage input terminal and a second initialization voltage input terminal; configured to controls to connect or disconnect the gate electrode of the driving transistor and the common node under the control of the reset control terminal, and controls to connect or disconnect the common node and the first initialization voltage input terminal; and controls to connect or disconnect the common node and the second initialization voltage input terminal under the control of the first control terminal, wherein, the power control sub-circuit includes a sixth transistor, and a gate electrode of the sixth transistor is connected to the first control terminal, a first electrode of the sixth transistor is connected to the power signal input terminal, and a second electrode of the sixth transistor is connected to the first electrode of the driving transistor;

the data writing-in sub-circuit includes a seventh transistor, a gate electrode of the seventh transistor is connected to the gate line of corresponding row, and a first electrode of the seventh transistor is connected to the data line of corresponding column, a second electrode of the seventh transistor is connected to the first electrode of the driving transistor;

the compensation sub-circuit includes an eighth transistor, a gate electrode of the eighth transistor is connected to the gate line of corresponding row, and a first electrode of the eighth transistor is connected to the second electrode of the driving transistor, a second electrode of the eighth transistor is connected to the gate electrode of the driving transistor.

9. A display device comprising the pixel driving circuit according to claim 1.

10. The display device according to claim 9, wherein the display device includes a display area and a peripheral area surrounding the display area, and the display device further includes a first initialization signal line and a second initialization signal line located in the peripheral area, the first initialization signal line and the second initialization signal line both extend along a first direction;

the display device includes a plurality of the pixel driving circuits arranged in the display area in an array, and in each of pixel driving circuits located in a same row along a second direction, the first initialization voltage input terminal connected to the first reset sub-circuit is connected to the first initialization signal line through a same first connection line;

in each of pixel driving circuits located in the same row along the second direction, the second initialization voltage input terminal connected to the first reset sub-circuit is connected to the second initialization signal line through a same second connection line, the first direction intersects the second direction.

11. A method for driving the pixel driving circuit according to claim 1, wherein the method comprises: in each working cycle, during a reset period, the first initialization voltage input terminal inputs a first initialization voltage, and under the control of the reset control terminal, the first reset sub-circuit controls to connect the first initialization voltage input terminal and the common node, and connect the common node and the gate electrode of the driving transistor in the driving sub-circuit; under the control of the first control terminal, the first reset sub-circuit controls to disconnect the second initialization voltage input terminal from the common node;

during a writing-in compensation period, under the control of the reset control terminal, the first reset sub-circuit controls to disconnect the first initialization voltage input terminal from the common node, and controls to disconnect the common node from the gate electrode of the driving transistor; the data line of corresponding column inputs a data voltage Vdata, and under the control of the gate line of corresponding row, the data writing sub-circuit controls to connect the data line of corresponding column and the first electrode of the driving transistor, the compensation sub-circuit controls to connect the gate electrode of the driving transistor and the second electrode of the driving transistor, so that the driving transistor is formed into a diode structure, a potential of the gate electrode of the driving transistor becomes Vdata+Vth, and Vth is a threshold voltage of the driving transistor;

during a light-emitting period, the power signal input terminal inputs a power voltage Vdd, and under the control of the first control terminal, the power control sub-circuit controls to connect the power signal input terminal and the first electrode of the driving transistor; under the control of the first control terminal, the first reset sub-circuit controls to connect the second initialization voltage input terminal and the common node; the difference between the potential of the second initialization signal inputted by the second initialization voltage input terminal and the potential of the gate electrode of the driving transistor during the light-emitting period is smaller than the threshold value.

12. The method according to claim 11, wherein when the first reset sub-circuit includes a first reset control sub-circuit, a second reset control sub-circuit and a third reset control sub-circuit, during the reset period, under the control of the reset control terminal, the first reset control sub-circuit controls to connect the gate electrode of the driving transistor and the common node, and the second reset control sub-circuit controls to connect the common node and the first initialization voltage input terminal at the same time; under the control of the first control terminal, the third reset control sub-circuit controls to disconnect the common node from the second initialization voltage input terminal;

during the writing-in compensation period, under the control of the reset control terminal, the first reset control sub-circuit controls to disconnect the gate electrode of the driving transistor from the common node, the second reset control sub-circuit controls to disconnect the common node from the first initialization voltage input terminal at the same time;

during the light-emitting period, under the control of the first control terminal, the third reset control sub-circuit controls to connect the second initialization voltage input terminal and the common node.

13. The method according to claim 11, wherein the pixel driving circuit further comprises a light-emitting control sub-circuit, and the second electrode of the driving transistor is connected to the light-emitting element through the light-emitting control sub-circuit; the light-emitting control sub-circuit is connected to the first control terminal, the second electrode of the driving transistor and the light-emitting element; the method further includes:

during the reset period and the writing-in compensation period, under the control of the first control terminal, the light-emitting control sub-circuit controls to disconnect the second electrode of the driving transistor from the light-emitting element, so that the light-emitting element does not emit light during the reset period and the writing-in compensation period.

14. The method according to claim 11, wherein the pixel driving circuit further comprises a second reset sub-circuit, the second reset sub-circuit is connected to the reset control terminal, the light-emitting element and the third initialization voltage input terminal;

during the reset period, under the control of the reset control terminal, the second reset sub-circuit controls to connect the third initialization voltage input terminal and the light-emitting element.

15. The method according to claim 14, wherein a potential of a third initialization signal inputted by the third initialization voltage input terminal is the same as a potential of a first initialization signal inputted by the first initialization voltage input terminal.

16. The pixel driving circuit according to claim 1, wherein a difference between a potential of a second initialization signal inputted by the second initialization voltage input terminal and a potential of the gate electrode of the driving transistor during a light-emitting period is smaller than a threshold value.

17. The display device according to claim 10, wherein the first initialization signal line and the second initialization signal line are both made of the same material and made at the same layer, the first initialization signal line and the second initialization signal line are arranged in sequence along the second direction.

18. The display device according to claim 10, wherein the first initialization signal line and the second initialization signal line are disposed at different layers, and an orthographic projection of the first initialization signal line on the substrate of the display device overlaps the orthographic projection of the second initialization signal line on the substrate of the display device.

19. The display device according to claim 10, wherein the first connection line and the second connection line are arranged at different layers.

20. A pixel driving circuit for driving a light-emitting element, comprising:

a driving sub-circuit, wherein the driving sub-circuit includes a driving transistor, and a second electrode of the driving transistor is connected to the light-emitting element;

a storage sub-circuit, wherein a first terminal of the storage sub-circuit is connected to a gate electrode of the driving transistor, and a second terminal of the storage sub-circuit is connected to a power signal input terminal;

a power control sub-circuit, connected to a first control terminal, the power signal input terminal and a first electrode of the driving transistor;

a data writing-in sub-circuit, connected to a gate line of corresponding row, a data line of corresponding column and a first electrode of the driving transistor;

a compensation sub-circuit, connected to the gate line of corresponding row, the gate electrode of the driving transistor and the second electrode of the driving transistor;

a first reset sub-circuit, connected to a reset control terminal, the first control terminal, the gate electrode of the driving transistor, a common node, a first initialization voltage input terminal and a second initialization voltage input terminal; configured to controls to connect or disconnect the gate electrode of the driving transistor and the common node under the control of the reset control terminal, and controls to connect or disconnect the common node and the first initialization voltage input terminal; and controls to connect or disconnect the common node and the second initialization voltage input terminal under the control of the first control terminal, wherein the pixel driving circuit further comprises:

a second reset sub-circuit, connected to the reset control terminal, the light-emitting element and a third initialization voltage input terminal; configured to control to connect or disconnect the third initialization voltage input terminal and the light-emitting element under the control of the reset control terminal.

* * * * *